US008101050B2

(12) United States Patent
Ellis et al.

(10) Patent No.: US 8,101,050 B2
(45) Date of Patent: Jan. 24, 2012

(54) SYSTEM, METHOD, AND APPARATUS FOR CONTINUOUS ELECTROPLATING OF ELONGATED WORKPIECES

(75) Inventors: Fife B. Ellis, Houston, TX (US); Charles E. Jennings, Houston, TX (US)

(73) Assignee: Vetco Gray Inc., Houston, TX (US)

( * ) Notice: Subject to any disclaimer, the term of this patent is extended or adjusted under 35 U.S.C. 154(b) by 1075 days.

(21) Appl. No.: 11/811,302

(22) Filed: Jun. 8, 2007

(65) Prior Publication Data

US 2007/0289868 A1 Dec. 20, 2007

Related U.S. Application Data

(60) Provisional application No. 60/815,025, filed on Jun. 20, 2006.

(51) Int. Cl.
*C25D 5/02* (2006.01)
*C25D 5/04* (2006.01)
*C25D 7/04* (2006.01)

(52) U.S. Cl. ..... 204/224 R; 204/225; 204/228.7; 204/272; 205/131; 205/132

(58) Field of Classification Search ..... None
See application file for complete search history.

(56) References Cited

U.S. PATENT DOCUMENTS

| | | | |
|---|---|---|---|
| 1,793,069 | A | 2/1931 | Dunkley |
| 1,805,215 | A | 5/1931 | Hammond |
| 2,106,004 | A | 1/1938 | Inglee |
| 3,125,464 | A | 3/1964 | Harmes |
| 3,673,073 | A | 6/1972 | Tobey et al. |
| 3,716,461 | A | 2/1973 | Ahmad |
| 4,750,981 | A | 6/1988 | Dalland et al. |
| 4,849,084 | A | 7/1989 | Vouzellaud |
| 5,277,785 | A | 1/1994 | Van Anglen |
| 5,453,174 | A | 9/1995 | Van Anglen et al. |
| 5,538,615 | A | 7/1996 | Palumbo et al. |
| 5,714,051 | A | 2/1998 | Van Leth et al. |
| 6,183,610 | B1 | 2/2001 | Kataoka et al. |
| 6,383,348 | B2 | 5/2002 | Kuroda et al. |
| 2003/0234181 | A1 | 12/2003 | Palumbo et al. |

FOREIGN PATENT DOCUMENTS

| | | | |
|---|---|---|---|
| GB | 1261636 | A | 1/1972 |
| GB | 1406081 | A | 9/1975 |
| JP | 3078068 | U | 3/1990 |
| JP | 8277491 | | 10/1996 |
| JP | 11029895 | A | 2/1999 |
| WO | WO 2004/001178 | A3 | 12/2003 |

*Primary Examiner* — Harry D Wilkins, III
(74) *Attorney, Agent, or Firm* — Bracewell & Giuliani LLP

(57) ABSTRACT

A system electroplates the interior or exterior cylindrical surfaces of an elongated workpiece, such as a pipe or shaft. The workpiece is continuously electroplated with metallic solutions via a traveling anode that gradually plates along the axial length of the workpiece instead of plating the entire part or large portions of the part at one time.

9 Claims, 3 Drawing Sheets

SYSTEM, METHOD, AND APPARATUS FOR CONTINUOUS ELECTROPLATING OF ELONGATED WORKPIECES

This application claims priority to and the benefit of U.S. Provisional Patent Application No. 60/815,025, filed on Jun. 20, 2006.

BACKGROUND OF THE INVENTION

1. Technical Field

The present invention relates in general to the electroplating of workpieces and, in particular, to an improved system, method, and apparatus for the continuous electroplating of the exteriors and/or interiors of elongated workpieces such as shafts and tubes.

2. Description of the Related Art

Historically, the metallic electroplating of parts or workpieces that more than 20 feet in length has been problematic and expensive due to the very large plating tanks that are required, and the significant volume of plating chemicals needed to fill the tanks. As the plating chemicals are toxic and have a finite life, there is an additional cost incurred for proper disposal according to EPA requirements.

In addition, large plating tanks have very large electrical power requirements. With a large tank plating operation, the entire part or surface of a workpiece is plated at one time. To successfully plate the surface of a workpiece, a specific amount of power per unit surface area is required, which is also known as the current density. If the entire part is to be plated at one time, such as in the case of large plating tanks, a larger power supply would be required.

For example, some offshore drilling and production platforms use ram-style tensioners having a 28 to 30 foot stroke length that is exposed to acids, etc., that cause corrosion. These types of workpieces are too long for conventional plating techniques. Thus, an improved process for applying plating metals with a different technique than conventional "tank plating" processes would be desirable. In particular, the ability to plate only small areas of the workpiece at a time, rather than all or large sections of a workpiece would be especially desirable.

SUMMARY OF THE INVENTION

Embodiments of a system, method, and apparatus for electroplating one or more surfaces of a workpiece are disclosed. The invention is particularly well suited for the continuous electroplating of metals on the interior or exterior cylindrical surfaces of an elongated workpieces. The invention uses a traveling anode to gradually plate along the axial length of a workpiece instead of plating the entire part or large portions of the part at one time. With a plating system that uses a traveling anode design, a very small amount of plating chemicals are used resulting in a more environmentally friendly solution that also has significantly lower operating costs.

The foregoing and other objects and advantages of the present invention will be apparent to those skilled in the art, in view of the following detailed description of the present invention, taken in conjunction with the appended claims and the accompanying drawings.

BRIEF DESCRIPTION OF THE DRAWINGS

So that the manner in which the features and advantages of the present invention, which will become apparent, are attained and can be understood in more detail, more particular description of the invention briefly summarized above may be had by reference to the embodiments thereof that are illustrated in the appended drawings which form a part of this specification. It is to be noted, however, that the drawings illustrate only some embodiments of the invention and therefore are not to be considered limiting of its scope as the invention may admit to other equally effective embodiments.

DETAILED DESCRIPTION OF THE INVENTION

Figure 1:
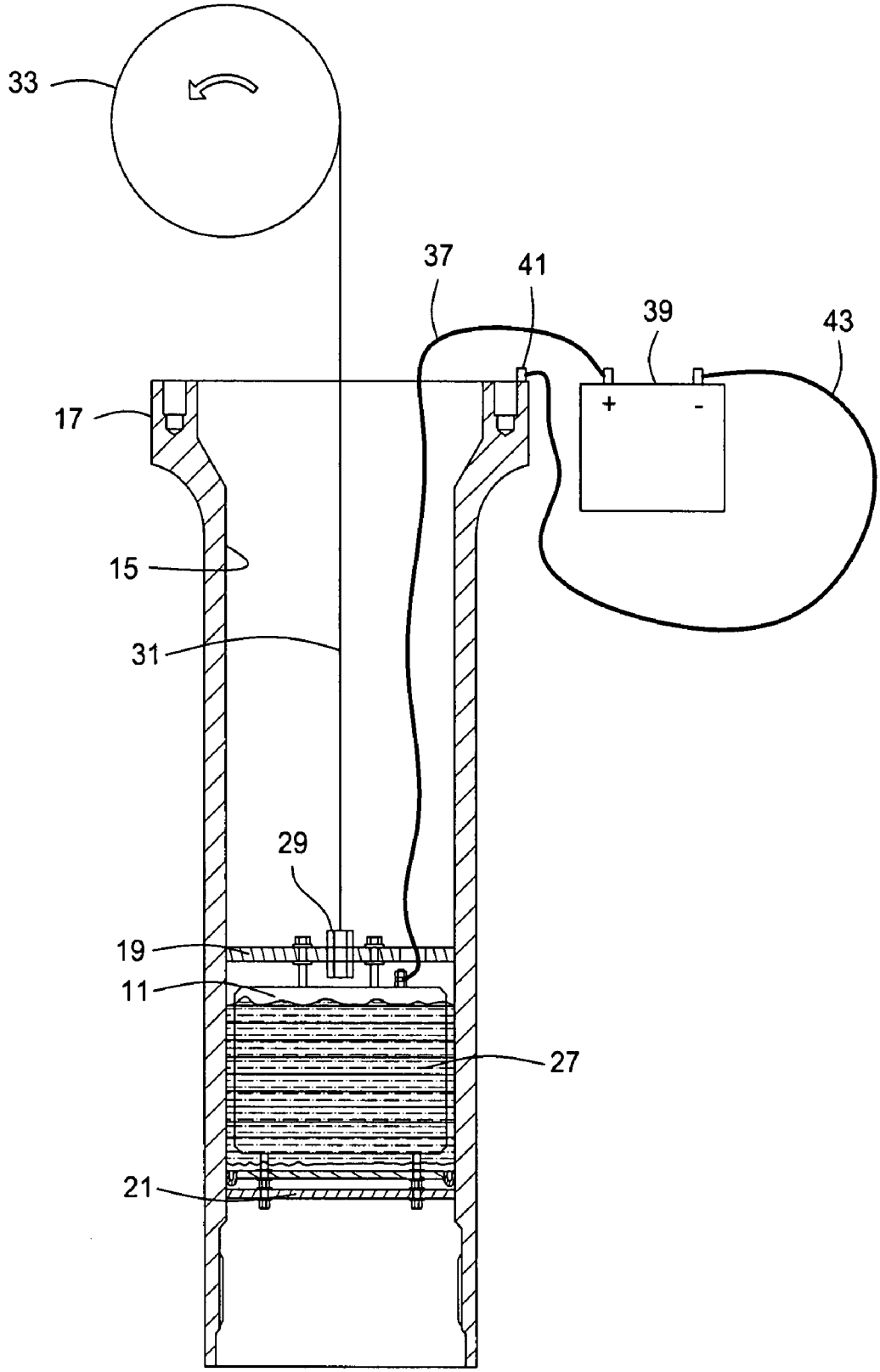
FIG. 1 is a sectional side view of one embodiment of a system for electroplating an interior surface and is constructed in accordance with the present invention.
Figure 2:
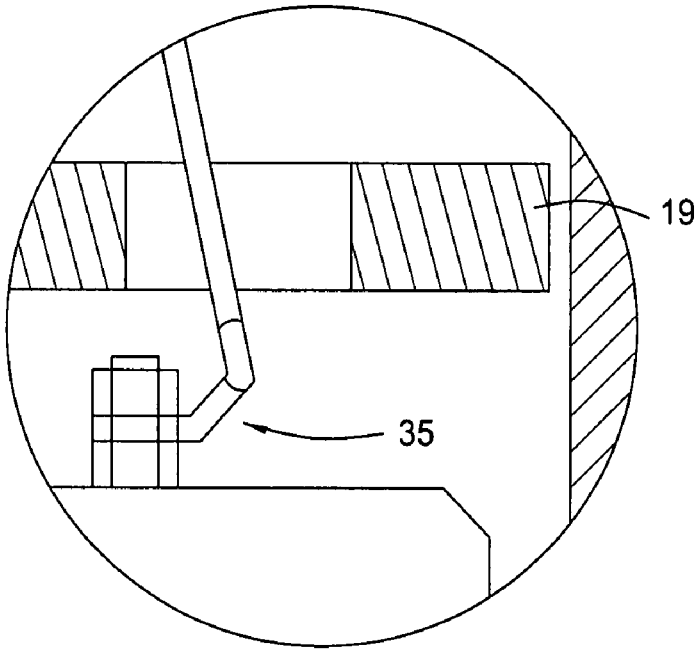
FIG. 2 is an enlarged sectional side view of an upper portion of the system of FIG. 1 and is constructed in accordance with the present invention.
Figure 3:
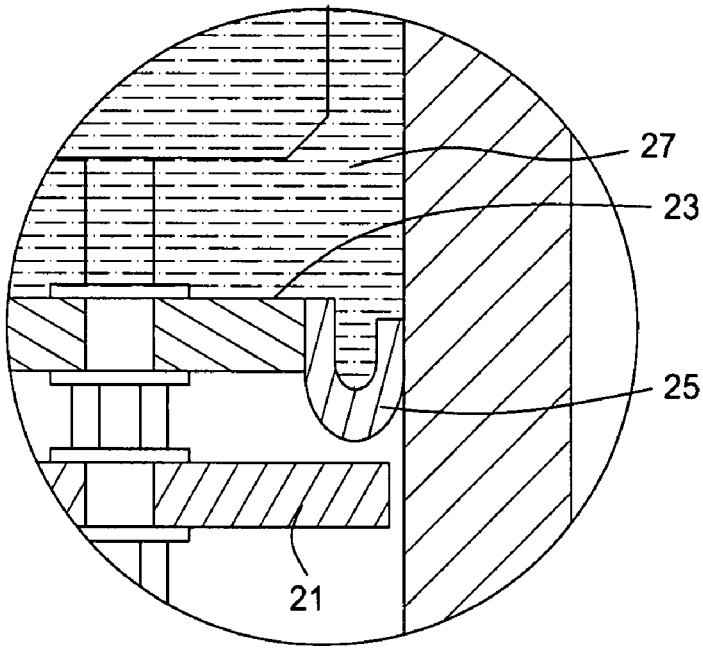
FIG. 3 is an enlarged sectional side view of a lower portion of the system of FIG. 1 and is constructed in accordance with the present invention.

Referring to FIGS. 1-3, one embodiment of a system, method, and apparatus for electroplating an interior surface is disclosed. This embodiment is particularly well suited for the continuous electroplating of metals on the interior cylindrical surface of an elongated workpiece, such as a shaft or tube.

For example, in the embodiment shown, a cylindrical anode 11 is immersed in a plating fluid solution 27. The anode 11 is centralized or radially aligned with respect to the inner diameter cylindrical bore 15 of the workpiece 17 with upper and lower, non-conductive guides 19, 21, respectively. Guides 19, 21 may comprise circular disks that are rigidly connected to the anode 11. A seal plate 23 (FIG. 3) and a non-conductive lip seal 25 are also rigidly connected to the anode 11. Seal plate 23 and seal 25 serve to retain the plating solution 27 in contact with the anode 11 and bore 15 of the workpiece 17. In one embodiment, the plating solution 27 may comprise nickel, chloride, nickel sulfamate, and boric acid, and nickel carbonate may be used to adjust pH. Other plating solutions may be readily employed depending on the application.

A lifting connection 29 is rigidly connected to the upper centralizing guide 19 and provides an attachment point to connect a lifting cable 31. An opposite end of the lifting cable 31 is connected to a drum reel 33 or other suitable lifting device that can lift or lower the assembly through bore 15 at a controlled rate. Alternately, items 29, 31, 33 may be duplicated on the opposite axial end of the anode assembly (i.e., on guide 21) such that the anode assembly can be pulled in the opposite or either axial direction.

In addition, a terminal post 35 (FIG. 2) is connected to the anode 11 and is used to connect a positive charge through a cable lead 37. The cable lead 37 is connected at an opposite end to the positive terminal of a DC power supply 39. A terminal post 41 is connected to the workpiece 17 and is used to connect a negative charge to a cable lead 43 from DC power supply 39. By applying a DC voltage with the power supply 39, material is plated onto the inner diameter bore 15 at a rate that is dependent on, e.g., the power supply, concentration of plating solution, and rate of movement of the assembly through the workpiece. In order to plate the entire length of the inner diameter bore 15 of the workpiece 17, the anode 11 can be either lowered or lifted at a controlled, predetermined rate so that a uniform plating thickness can be obtained over the entire length of the part.

Figure 4:
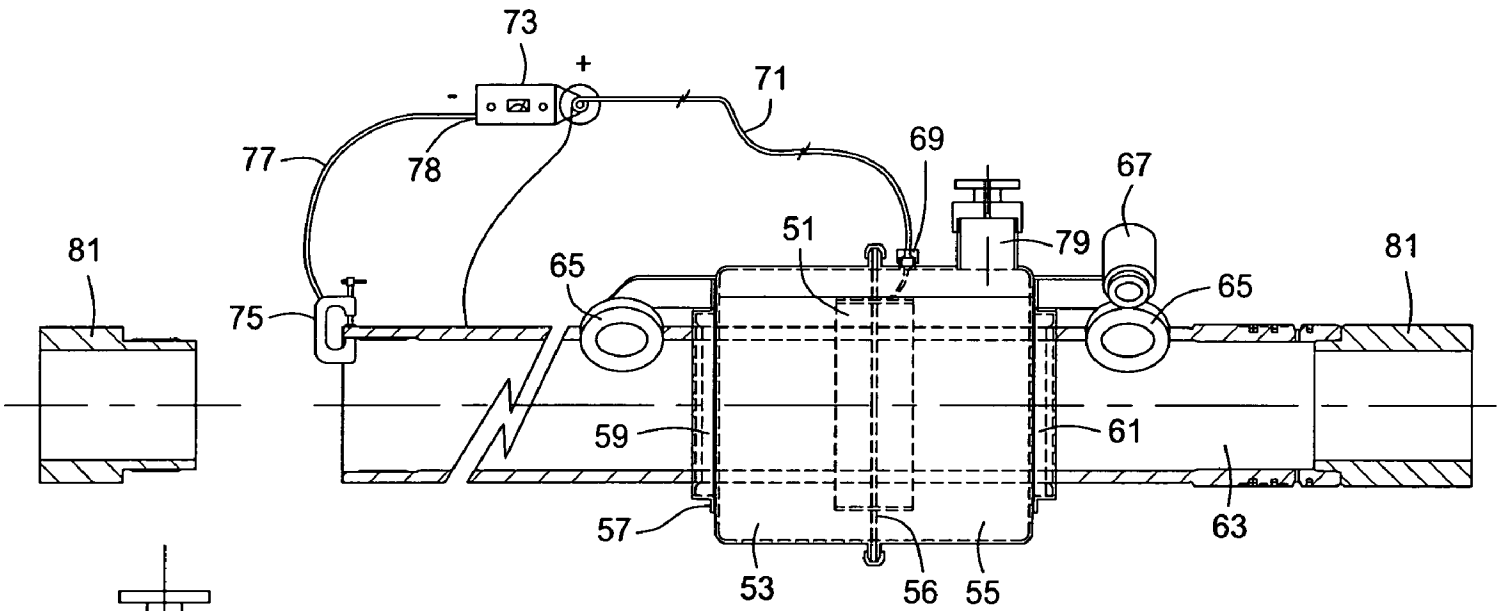
FIG. 4 is a side view of another embodiment of a system for electroplating an exterior surface and is constructed in accordance with the present invention.
Figure 5:
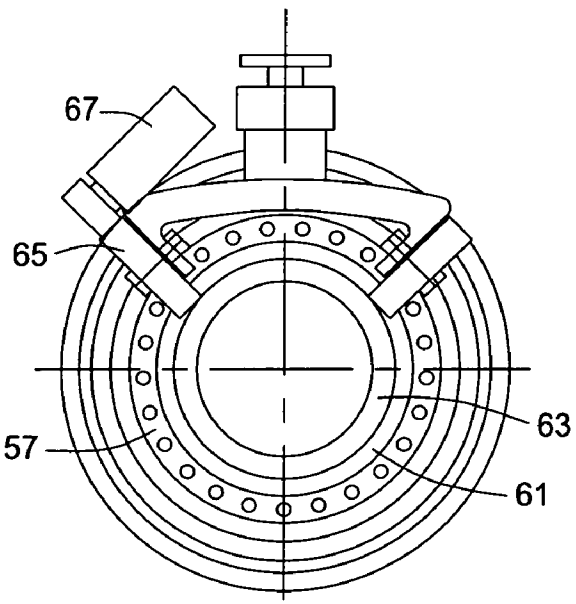
FIG. 5 is an end view of the system of FIG. 4 and is constructed in accordance with the present invention.

Referring now to FIGS. 4 and 5, another embodiment of the invention for electroplating an exterior surface is disclosed. This embodiment is particularly well suited for the continuous electroplating of metals on the exterior cylindrical surface of an elongated workpiece, such as a shaft or tube. Like the previous embodiment, only small areas of the cylinder are plated at any one time with a traveling anode that gradually plates along the length of the workpiece instead of plating the entire part at one time.

The process for applying plated metals onto the cylindrical exterior is similar to the process described above. The outer surface plating of round or cylindrical parts is accomplished using a short, cylindrical shaped anode 51 that is immersed in a plating fluid solution 53 held in a cylindrically shaped tank 55. The anode 51 is centrally located by a centering device 56 that is rigidly connected to the tank 55. The centering device 56 also serves to electrically insulate the anode 51 from the tank 55 and may be formed from non-conductive materials such as a wood or plastic rib. However, one skilled in the art will recognize that there are numerous ways to locate the anode 51 with respect to the tank 55.

In one embodiment, the tank 55 uses two non-conductive flanged seal plates 57 with lip seals 59, 61, located at respective ends of the tank 55. Seals 59, 61 form low pressure seals between the tank 55 and the workpiece 63 to retain the plating solution 53 in the tank 55. The flanged plates 57 are used to accommodate the different diameters of various types of workpieces to enable greater adaptability for different applications.

In order to centralize the tank 55 and anode 51 to the outer diameter of the workpiece 63, a set of support wheels 65 are rigidly secured to the tank 55, but allowed to freely rotate. A drive motor 67 is connected to at least one of the support wheels 65 to control the speed or rate of movement of the assembly of tank 55 and anode 51 along the length of the workpiece 63. Alternately, the tank assembly may be moved along the workpiece in manner similar to the previous embodiment.

In one embodiment, the electrical connections are provided by a terminal post 69 located on tank 55. Post 69 is used to attach a positive charge via a spooled cable lead 71 extending from a DC power supply 73 (e.g., rectifier), before terminating on the anode 51. A cable 77 extends between a clamp 75 or other securing means that is connected to the workpiece 63, and a negative terminal 78 on the DC power supply 73 to complete the electrical circuit of the plating process.

A fill port 79 is provided on top of the tank 55 and serves as a port for adding chemical plating solution and monitoring the fluid level of tank 55. As shown in FIG. 4, extensions 81 for plater run out may be installed on the axial ends of workpiece 63. Extensions 81 (left side exploded view; right side installed) allow the plating system to smoothly travel beyond the axial ends of workpiece 63 so that the entire exterior surface of workpiece 63 may be plated.

The present invention has many advantages. This design greatly enhances the ability to plate long parts without having to source or build large tanks that can accommodate parts of this size. With a smaller power supply requirement for the traveling anode, lower initial capital costs are achieved over conventional large tank plating systems. This solution is also much more cost effective than conventional laser-cobalt cladding techniques or brush plating techniques.

Another advantage of the traveling anode plating system over conventional large tank plating systems is a reduction in the size of the anode. As the entire part is plated at one time with a large tank plating system, the plating anode must be as long as the part to be plated. Typically the anodes are designed and made for a particular part to be plated. For parts in excess of 25 to 30 feet in length, the cost can be quite large due to the manufacturing requirements for non-standard, or unique features of such a component, as well as the handling and shipping requirements.

In comparison, the traveling anode plating system uses a short anode that is more economical. The shorter anode has more universal application in comparison to long anodes that are built for specific applications, as it can be used for parts of any length. In addition, the smaller size of the tank and components that make up the traveling anode plating system allow it to be a portable system. With long parts this is a very significant advantage over conventional large tank plating systems since the present invention can be brought to the workpiece, which greatly reduces shipping and handling costs as well as reductions in processing time. This is particularly important in the case of long parts as there is only a small group of vendors that have the capacity to perform large tank plating operations. Furthermore, these vendors are dispersed in remote areas of the country for environmental reasons.

While the invention has been shown or described in only some of its forms, it should be apparent to those skilled in the art that it is not so limited, but is susceptible to various changes without departing from the scope of the invention.

For example, although the first embodiment is shown in a vertical orientation, it may be reconfigured in other orientations as well, including horizontal directions. Such an embodiment may include, for example, means for maintaining a full fluid level of the plating solution between the seals, and means for continuously replenishing the supply of plating solution as well. Likewise, the second embodiment has the same adaptability for vertical configurations instead of the horizontal configuration shown. Moreover, the present invention is not limited to plating round or cylindrical workpieces. The shape of the invention can be reconfigured to the shape (interior or exterior) of almost any workpiece.

What is claimed is:

1. A system for electroplating a workpiece, the workpiece having an interior with a surface, comprising:

an anode having an axis configured to be located in the interior of the workpiece adjacent to the surface and immersed in an electroplating fluid solution;

a centralizer mounted to the anode for centralizing the anode within the interior of the workpiece, the centralizer being electrically non-conductive;

a seal mounted to the anode for retaining the electroplating fluid solution in contact with the anode and the surface of the workpiece, wherein the seal is in sealing engagement with the surface of the workpiece while the anode and seal move through the interior of the workpiece;

a cable wrapped around a drum reel and operatively coupled to the anode, centralizer, and seal for moving the anode, centralizer, and seal through the interior at a controlled rate;

an electrical power supply electrically connected via a first wire leading to the anode and a second wire to the workpiece for supplying a voltage to the anode, through the electroplating fluid solution, and to the workpiece to plate the surface with the electroplating fluid solution; and wherein the wire is spaced apart from the cable.

2. A system according to claim 1, wherein the surface is a cylindrical bore, the centralizer comprises non-conductive, circular guide disks located on opposite axial ends of the anode for radially aligning the anode within the cylindrical bore, and the anode is cylindrical.

3. A system according to claim 1, wherein the seal comprises a seal plate mounted to the anode and a lower portion of the centralizer, the seal plate being located between a lower end of the anode and the lower portion of the centralizer, a non-conductive lip seal extending around a circumference of the seal plate for retaining the electroplating fluid solution in contact with the anode and the surface of the workpiece.

4. A system according to claim 3, wherein the lip seal has an inner wall and an outer wall joined at a base, defining a generally U-shaped configuration with the walls extending upward from the base, the inner wall being joined to the seal plate and the outer wall adapted to engage the cylindrical bore of the workpiece.

5. A system according to claim 1, wherein:

the centralizer comprises an upper disk above the anode and a lower disk below the anode;

the cable secures to a lifting connection mounted to the upper disk on the axis of the anode; and the first wire extends through an opening in the upper disk to the anode, the opening being offset from the lifting connection.

6. A system according to claim 1, wherein the anode is continuously moved through the workpiece at a controlled, predetermined rate so that a uniform plating thickness is obtained on the surface over an entire length of the workpiece.

7. A system for electroplating a cylindrical wall of a bore of an offshore platform tensioner, comprising:

an anode having an axis and configured to be lowered into the bore of the tensioner and immersed in an electroplating fluid solution;

an upper centralizer disk mounted to an upper end of the anode;

a lower centralizer disk mounted to a lower end of the anode, the upper and lower centralizer disks having diameters larger the anode for centralizing the anode within the bore of the tensioner, the upper and lower centralizer disks being electrically non-conductive;

a seal plate mounted between the lower end of the anode and the lower centralizer disk, the seal plate having a diameter smaller than the upper and lower centralizer disks;

a lip seal mounted to a circumference of the seal plate, the lip seal having a diameter larger than the upper and lower centralizer disks for sealing engagement with the wall of the bore of the tensioner;

a cable wrapped around a drum reel and operatively coupled to the upper centralizer disk for lowering and raising the anode within the bore of the tensioner at a controlled rate;

the lip seal adapted to maintain a seal with the bore of the wall of the tensioner while the drum reel moves the anode within the bore of the tensioner; and an electrical power supply electrically connected to the anode and to the tensioner for supplying a voltage to the anode and through the electroplating fluid solution to plate the wall of the bore with the electroplating fluid solution.

8. The system according to claim 7, wherein the lip seal has an inner wall and an outer wall joined at a base, defining a generally U-shaped configuration with the walls extending upward from the base, the inner wall being joined to the seal plate and the outer wall adapted to engage the wall of the bore of the tensioner.

9. A system for electroplating a cylindrical wall of a bore of an offshore platform tensioner, comprising:

an anode having an axis and configured to be lowered into the bore of the tensioner and immersed in an electroplating fluid solution;

an upper centralizer disk mounted to an upper end of the anode;

a lower centralizer disk mounted to a lower end of the anode, the upper and lower centralizer disks having diameters larger the anode for centralizing the anode within the bore of the tensioner, the upper and lower centralizer disks being electrically non-conductive;

a seal plate mounted between the lower end of the anode and the lower centralizer disk, the seal plate having a diameter smaller than the upper and lower centralizer disks;

a lip seal mounted to a circumference of the seal plate, the lip seal having a diameter larger than the upper and lower centralizer disks for sealing engagement with the wall of the bore of the tensioner;

a cable wrapped around a drum reel and coupled to the upper centralizer disk on the axis of the anode for lowering and raising the anode within the bore of the tensioner at a controlled rate;

the lip seal adapted to maintain a seal with the bore of the wall of the tensioner while the drum reel moves the anode within the bore of the tensioner;

an electrical power supply electrically connected to the anode via a first wire and to the tensioner via a second wire for supplying a voltage to the anode and through the electroplating fluid solution to plate the wall of the bore with the electroplating fluid solution; and wherein the first wire is separate from and extends alongside the cable through an opening in the upper centralizer disk to the anode, the opening being offset from the axis of the anode.

* * * * *